United States Patent [19]

Swanson et al.

[11] 3,961,425

[45] June 8, 1976

[54] TEMPERATURE CONTROL SYSTEM FOR TEXTILE TENTER FRAME APPARATUS

[75] Inventors: S. Keith Swanson, Saratoga; David E. Stepner, Cupertino, both of Calif.

[73] Assignee: Measurex Corporation, Cupertino, Calif.

[22] Filed: June 18, 1975

[21] Appl. No.: 587,952

[52] U.S. Cl. ..... 34/25; 26/92; 34/52; 34/158

[51] Int. Cl.[2] ..... F26B 3/04

[58] Field of Search ..... 26/60; 34/52, 158, 25, 34/28, 32, 33

[56] References Cited

UNITED STATES PATENTS

| | | | |
|---|---|---|---|
| 1,926,292 | 9/1933 | Kruse | 34/52 |
| 2,150,445 | 3/1939 | Jennings et al. | 34/25 |
| 2,223,117 | 11/1940 | Miller | 34/25 |
| 2,466,446 | 4/1949 | Laurie | 34/52 |
| 2,559,713 | 7/1951 | Dunski et al. | 34/52 |
| 2,942,352 | 6/1960 | Eicken-Estienne | 34/52 |
| 3,395,459 | 8/1968 | Taylor | 34/52 |
| 3,732,435 | 5/1973 | Strandberg et al. | 34/52 |
| 3,783,527 | 1/1974 | Driscoll et al. | 34/52 |

*Primary Examiner*—Kenneth W. Sprague
*Assistant Examiner*—Larry I. Schwartz
*Attorney, Agent, or Firm*—Owen, Wickersham & Erickson

[57] ABSTRACT

An automatic temperature control system for a textile tenter frame having an oven section for heating the fabric in order to "set" its fibers in an essentially non-shrinkable state. The system operates to maximize the speed of the tenter frame while maintaining optimum heat set conditions. Fabric temperature from within the oven and initial moisture content data are furnished to a computer and processed with time-at-temperature target inputs to provide tenter frame speed control output signals.

8 Claims, 2 Drawing Figures

TEMPERATURE CONTROL SYSTEM FOR TEXTILE TENTER FRAME APPARATUS

BACKGROUND OF THE INVENTION

This invention relates to an automatic temperature control system for a textile tenter frame apparatus.

In the operation of a textile tenter frame, the fabric within the tenter housing is heated to remove moisture. It is also necessary to bring the fabric (particularly synthetic fabrics) to predetermined temperature level for a period of time that will cause the fabric fibers to "set" in an essentially non-shrinkable state. With regard to this heat set temperature, the process of heating the fabric is initially one of driving the water from the fabric in a first heating zone within the frame, then elevating the fabric temperature in a second heating zone to the desired heat set temperature. Because of the typical moisture level in the fabric as it enters the tenter frame (usually from 20% to 40%) and the relationship of the specific heat and heat of vaporization of water as compared to the fabric specific heat, the major portion of heat energy is consumed in driving the water out of the fabric and accordingly the ultimate temperature of the fabric is heavily influenced by the moisture level of the fabric entering the tenter frame. This initial moisture level is caused by a number of factors such as knitting style, yarn surface quality, present water chemistry affecting surface tension and operation of the mechanical means for removing some of the water prior to tenter frame entry such as squeeze roll or a vacuum slot.

Prior to the present invention, the operator of a tenter frame apparatus was required to select a speed which would provide the desired heat set temperature of the fabric within the frame. If the proper set temperature was not reached during the heat set operation, a non-stable fabric was produced which would shrink during the subsequent washing, drying and pressing operations of a finished garment. On the other hand, if the operator allowed excessive temperatures to occur within the tenter, the fabric became scorched and unusable. Thus the operator's problem was to operate the tenter frame at a slow enough speed to provide the proper heat set temperature for the fabric and yet at a fast enough speed to prevent scorching and also provide an optimum production rate. Heretofore, the operator's decision on tenter frame speed setting were based primarily on his own prior experience or on the feel or observation of the material at the exit end of the tenter. Such reliance on the operator's skill and expertise or lack of same was often inefficient and costly, particularly in larger scale textile manufacturing facilities. The present invention solves the aforesaid problem and removes the uncertainty of temperature control in a tenter frame apparatus while also providing for an optimum production rate from the tenter frame.

OBJECTS AND SUMMARY OF THE INVENTION

It is therefore a general object of the invention to provide an automatic temperature control system for a fabric tenter frame apparatus.

The present invention provides an automatic control system that causes the fabric to be heated within the tenter frame housing to at least a specified temperature and maintained at the proper temperature level for a specified period of time so that the desired "heat set" characteristics of the fabric material is achieved. Moreover, the system achieves the proper time-at-temperature value for the fabric being treated while allowing the tenter frame to operate at maximum speed. Heater means raise the temperature of the fabric within the tenter frame housing and temperature sensors spaced along the linear path of the fabric provide actual temperature data through an analog to digital converter to a processor or computer device. Within the processor, the temperature data is utilized with algorithms based on known heat-transfer principles to provide a characteristic time and temperature increase relationship for the fabric being processed. From the resulting data the processor also determines the time and thus the relative distance from a reference point at which the fabric may be expected to exceed a known heat set limit. The latter, in the form of a time at temperature target, is placed into the processor by an operator and is summed with the computed predicted value to provide a control error signals that will cause appropriate control moves for the drive means on the tenter frame belts. In addition to the aforesaid temperature sensor inputs material moisture content of the fabric is also taken into consideration by supplying the processor with data from a moisture gauge located at the entry to the tenter frame. Thus, for all cases the tenter frame will operate to provide the proper time at temperature value for the fabric while the tenter frame operates at its maximum speed.

Another object of the invention is to solve the problems in fabric processing in a tenter frame relating to variations in heat set temperature caused by variations in entry moisture and also variations in heat transfer characteristics of the fabric.

A further object of the present invention is to provide constant heat set time and temperature characteristics for a fabric in a tenter frame regardless of variations in entry moisture level of the fabric and regardless of the thermodynamic characteristics of the tenter frame heating zones.

The foregoing and other objects are accomplished in a tenter frame apparatus wherein fabric to be treated is fed from a supply to a tenter frame comprised of a pair of spaced apart belts that are movable by controllable drive means within a housing. Thus predicted temperature is compared to the target temperature to produce control signals and cause appropriate control moves to be made to the tenter drive control for producing the target heat set temperature.

Other objects, advantages and features of the present invention will become apparent from the following detailed description of one embodiment thereof, presented in conjunction with the accompanying drawing.

DETAILED DESCRIPTION OF EMBODIMENT

Figure 1:
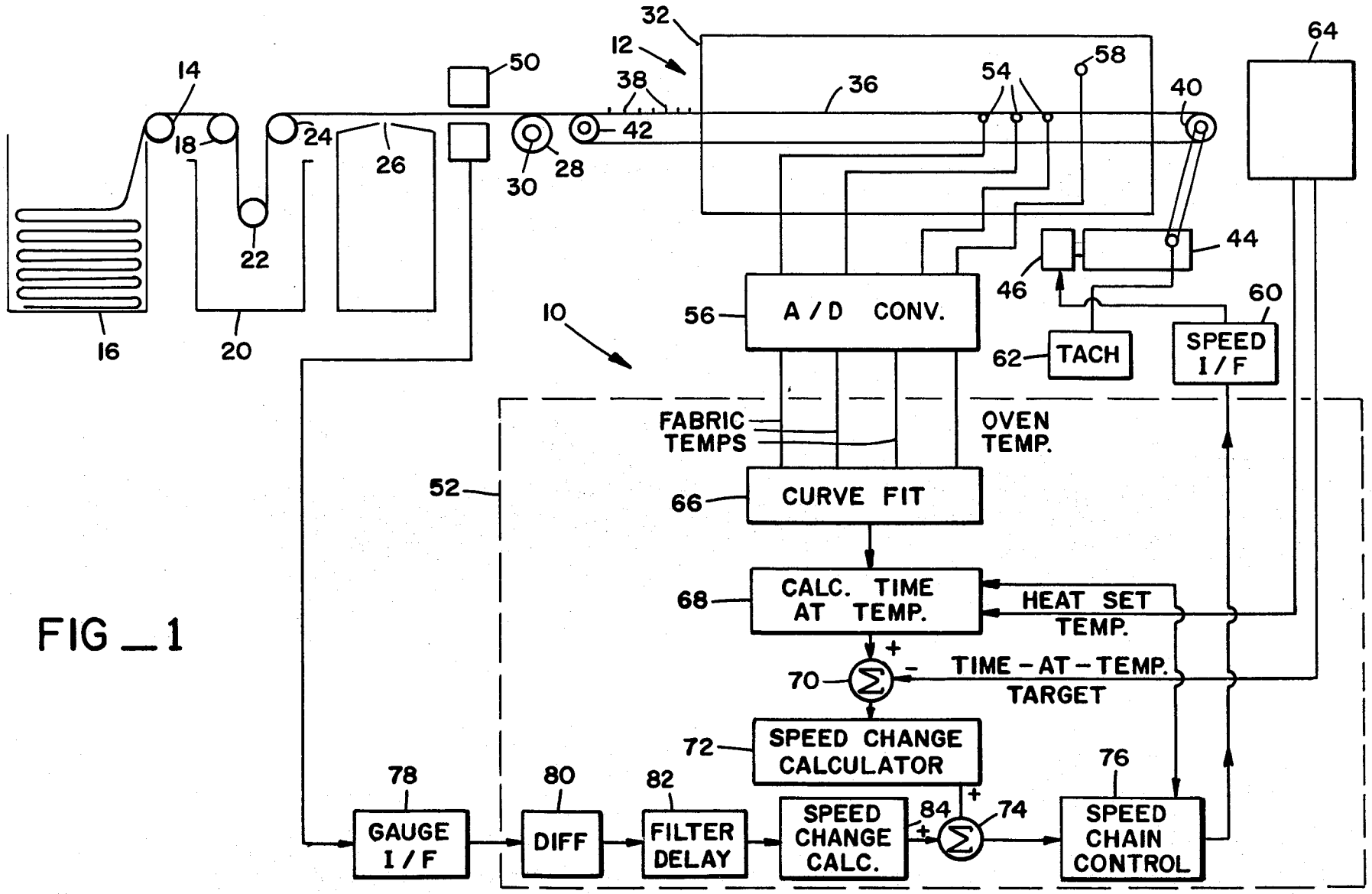
FIG. 1 is a schematic representation of a tenter frame apparatus utilizing a control system according to the present invention.

With reference to the drawing FIG. 1 shows schematically a temperature control system 10 for a conventional textile frame apparatus 12 wherein a fabric material 14, such as a knitted fabric, is fed from a coiled roll or a supply bin 16 into the tenter line 12 for the treatment required before the fabric can be used to make garments. The fabric material is passed over a first guide roll 18 and thence into a wetting tank 20 where it is moistened and then passed around a guide roll 22. The fabric is then lifted out of the tank 20 by a second guide roll 24 and it may be passed over a vacuum slot 26 for removing excess moisture before being transferred to an overfeed roll 28. The overfeed roll 28, normally driven by a servo motor 30, feeds the fabric material 14 to the tenter frame 12 at a controlled rate. The tenter frame which may be typically 60 – 90 feet long extends within an enclosure or oven 32 having a dryer section supplied with heat from a suitable source such as a series of internal heater elements (not shown). As the fabric material 14 is carried along by the tenter frame within the enclosure, the heater elements provide the heat that drives the moisture from material 14 and then brings its temperature up to the heat set temperature which causes it to shrink longitudinally.

As schematically shown, the tenter frame 12 comprises a pair of parallel, longitudinal belts 36, each carrying a series of upstanding plural engagement needles or clips 38 in a spaced apart configuration which holds the fabric 14 to its original lateral size during the drying operation for holding the fabric. Each belt 36 is positioned to engage one edge portion of the fabric 14 and is passed around a driving sprocket 40 and an idler sprocket 42. A drive motor 44 with an attached servo control 46 is mechanically linked as by a belt or chain 48 to each driving sprocket 40. Hence, the speed or teach tenter frame belt 36 is independently variable and the overall tenter frame speed may be controlled at a predetermined desired rate.

As the fabric passes to the overfeed roll 28 before entering the tenter frame 12, it preferably passes through a scanning sensor device 50 where measurement of the fabric moisture content is made. Input signals from the sensor device 50 are fed to a digital processor 52 which may be a special purpose minicomputer, or a general purpose computer, according to the principles of the present invention.

Within the elongated oven 32 for the tenter frame 12 are a series of temperature sensors 54 which are mounted at spaced apart locations along the direction of fabric travel to determine the fabric temperature at these various preselected measurement points. These temperature sensors which may be three or more in number are connected by suitable leads to an analog to digital converter 56 which provides digital signals to the processor 52. A separate temperature sensor or thermocouple 58 located within the oven housing 32 to provide oven bulk temperature, is also connected through the A/D converter to the processor.

The controllable servo motors 46 for the tenter frame drive motors 44 are connected through a suitable electrical interface 60 to the processor which may be a Hewlett Packard digital computer, such as their model 2100. At least one drive motor is also connected to the processor through a digital tachometer 62. Adjacent to or in communication with the processor 52 is an operator's station 64 from which target value inputs and other control parameters can be applied to the computer in the conventional manner.

In accordance with the principles of the present invention, the control system 10 operates to maintain the tenter frame at maximum allowable speed while ensuring that the fabric within the tenter frame housing 32 is heated to a specified temperature for a period of time sufficient to provide the proper molecular set for the fabric fiber material. The determination of the time and temperature factors are accomplished within the processor using data supplied from the fabric temperature sensors 54 and the bulk temperature thermocouple 58.

Applying well known heat transfer principles (See Heat Transmission by William McAdams, McGraw Hill, 1934, New York) a limiting case of unsteady heat conduction is provided by considering a thin slab of material having volume V, surface area A, and thickness $2r_m$, at temperature T, in contact with warmer air at uniform temperature $T_a$. Defining has the coefficient of heat transfer, and assuming h A/V $\rho$ $C_p$ (where $\rho$ is the density and $C_p$ the specific heat) is constant, the temperature of the material at any time t is given by $$\ln \frac{Ta - Tb}{Ta - T} = \frac{h\,A}{V\rho\,Cp}\,t \qquad (1)$$

where $Tb$ is the initial material temperature. Since a time-distance relation exists for fabric running through the tenter frame 12 even at (an approximately) constant speed, this equation (1) can be modified to give the temperature $T(d)$ at any distance $d$ beyond some reference point at which the temperature is $Tb$. With $Ta$ as the even temperature, the modified equation is $$T(d) = T_a - (T_a - T_b)\,e^{-Kd} \qquad (2)$$

where $$K = \frac{h\,A}{V\rho\,Cp}$$

of equation (1)

In the control system 10 according to the invention the fabric temperature measurements (more than 3) are made by the sensors 54 as the fabric moves in the longitudinal (machine direction) direction within the tenter frame oven. A least squares algorithm (See Introduction to Sequential Smoothing and Prediction by Norman Monison, McGraw Hill, 1969, New York) is now used to find the values of $Tb$ and $K$ which provide the best fit to the curve given by the measured points when the expression $$J = \sum_{i=1}^{n} [T(d_1) - T^*(d_1)]^2 \qquad (3)$$

is minimized, where n is the total number of measurement points, $T(d_1)$ is the temperature at distance $d_1$ given by equation (2) and $T(d_1)$ is the measured temperature at distance $d_1$. The curve fit computations are accomplished by the processor section indicated by the box 66, using conventional procedures.

Once the equation (2) has been established within the processor using the inputs from the sensors 54 and the oven temperature thermocouple 58 ($Ta$), the point of transition ($d_H$), where the fabric temperature first becomes greater than the heat set temperature $T_H$, can be found from $$d_H = \frac{-1}{K} \ln \frac{T_H - T_a}{T_b - T_a} \qquad (4)$$

Then, knowing the tenter frame speed V and the distance from the point of transmission to the frame exit or the entrance to its cooling zone, ($d_c$), the time at temperature can be found from $$t_H = \frac{d_c - d_h}{V} \quad (5)$$

The computations of equations (4) and (5) are also performed in the processor 52 within a "time-at-temperature" calculation section 68.

Figure 2:
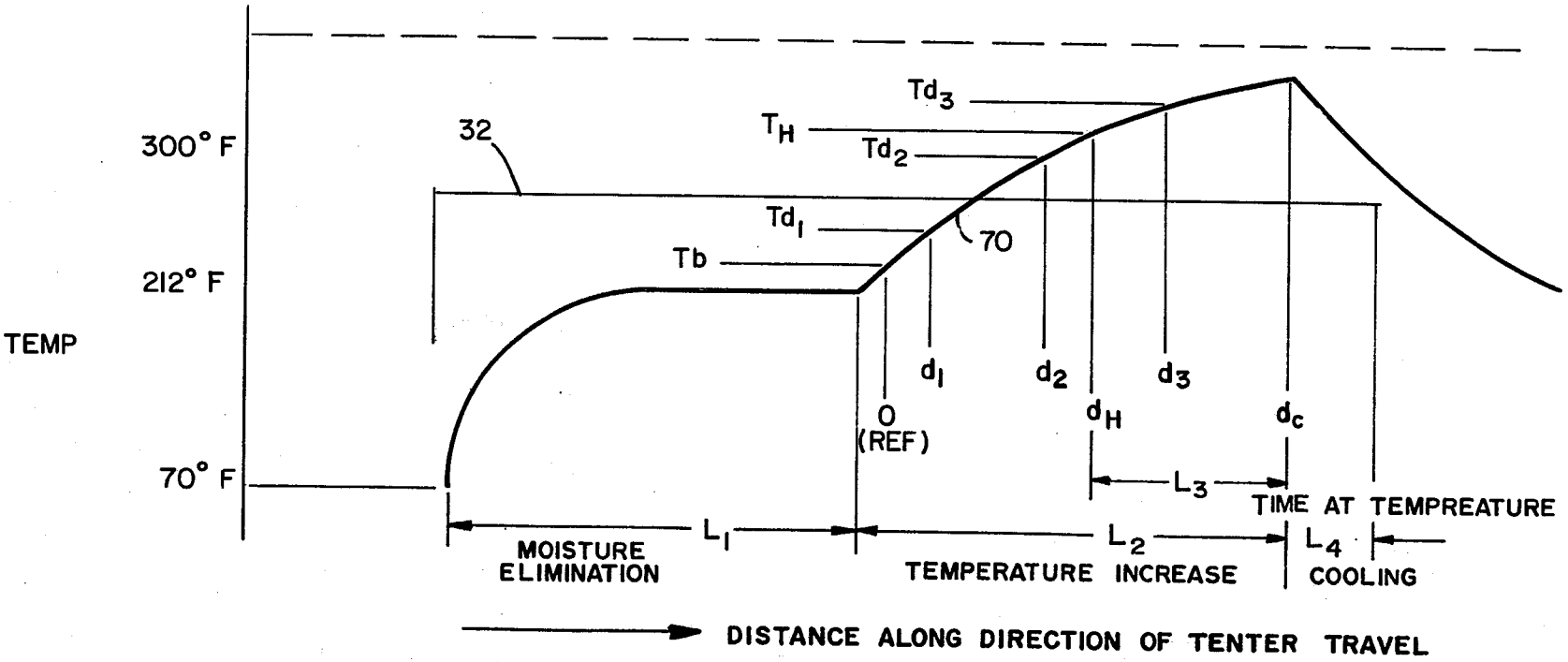
FIG. 2 is a graph showing a typical variation of fabric temperature as the fabric passes through a tenter frame apparatus.

Diagrammatically, the solved for quantities are shown in FIG. 2 wherein a curve for fabric temperature variation is represented qualitatively with reference to the distances of fabric travel provided in a typical tenter frame oven section.

In this diagram a distance of frame and frame travel $L_1$ is shown which represents a distance of travel within the housing wherein the heat is removing moisture from the fabric after a fabric temperature of 212° F. has been reached. In the next travel distance $L_2$, the fabric is being raised in temperature along a curve 70 which is established by data from the sensors 54. As indicated, these sensors are located at distances $d_1$, $d_2$, and $d_3$, from a reference point 0, which is at the temperature $T_b$. At the end of the distance is a time-at-temperature period or distance $L_3$ and this is followed by a period or distance during which a cooling phase commences as the fabric leaves the housing 32.

The "time-at-temperature" value may be defined as that amount of time at which the fabric is held at a temperature level which will cause the fabric fibers to chemically "set" in their permanent polymeric formation so that shrinkage will be minimized due to subsequent temperature fluctuations. In the tenter frame process, if the measured time-at-temperature quantity, $T_H$, for a particular fabric is less than a desired time, the tenter frame must be slowed down. If the measured time-at-temperature quantity, $T_H$, is greater than the desired time, the frame must speed up. In this way the frame speed will always be at a near optimum level for production throughput coincident with proper heat setting. Thus, within the processor 52, the output from the processor section 68 is fed to a summing section 72 in the processor which also receives a target time-at-temperature input from the operator's station 64. The output from the summing section 70 is supplied to a speed change calculation section 72 which computes the time-at-temperature error signal into a speed change signal and supplies it to another summing section 74.

The output of this latter summing section is furnished to a chain speed control section 76 of the processor which also receives an input from the tenter drive tachometer 62. This control section 76 provides an output control signal to the servo motor speed control 46 for the tenter frame drive motors 44 which either increases or decreases the tenter frame speed accordingly.

The moisture gauge 50 which measures the water content of the fabric coming into the tenter frame 12 provides an additional dimension of control. Signals from the moisture gauge are supplied to a gauge interface section 78 whose output is furnished to a difference section 80, a filter delay 82 and a speed change calculation section 84 in the processor. The output from the latter calculation section is furnished to the summing section 74 to modify, when necessary, the speed change error signal to the chain speed control section 76 in response to sensed moisture variation in the fabric.

Regulation of the frame speed as a function of moisture content assures that, at a given point within the frame, all the water will have been driven out, thereby making the heat set within the oven more uniform. For example, if the moisture trend of the fabric increases (as often happens when running fabric from the bottom of a bin or bucket in which it has been draining) the control will slow down the frame, thereby maintaining a fixed time-at-temperature. If the frame, under the same conditions had not been slowed down, the crossover point would have occurred further towards the end of the oven, due to unusual time to drive off water. This would result in a shorter than required time-at-temperature.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. In a tenter frame for supporting fabric to be heat treated to set the fabric fibers and thereby minimize future shrinkage including means for driving the tender frame and the fabric supported thereby in a linear direction; means for controlling the driving means of the tenter frame, and an oven housing around said tenter frame including means therein for heating and drying the fabric on the moving tenter frame, an automatic control system for the tenter frame comprising:

means for measuring the temperature of the moving fabric on the tenter frame within said housing and the bulk air temperature within said housing;

means for measuring the actual speed of the tenter frame;

computer means responsive to said temperature measuring and speed measuring means for computing a predicted time-at-temperature value for the fabric within said tenter frame, and for comparing it with a preselected target value for heat set temperature and time-at-temperature to provide output control signals; and means extending from said computing means and connected to said drive means for utilizing said output control signals to change its speed and thereby achieve said target value.

2. The control system as described in claim 1 including a moisture gauge means for measuring actual moisture content of the fabric before it enters the tenter frame; and means within said computer means for processing data signals from said moisture gauge to vary said output control signals in response to variations in the initial moisture content of the fabric.

3. The control system as described in claim 1 wherein said means for measuring the temperature of the moving fabric within the oven housing includes a series of at least three spaced apart temperature sensors.

4. The control system as described in claim 3 including means for converting analog data from said temperature sensors to equivalent digital data and supplying it to said computer means.

5. The control system as described in claim 4 wherein said computer means includes means utilizing data from said temperature sensors for establishing a temperature versus distance curve and predicting said time-at-temperature value.

6. A method for controlling a textile tenter frame having movable belt means extending within an oven housing for supporting an elongated piece of fabric material, drive means for said belt means and an oven means through which said belt means passes so that it will provide proper temperature treatment of the fabric material with maximum operating speed, said method comprising the steps of:

sensing and producing data signals equivalent to the temperature of the fabric material at linearly spaced apart locations within said oven means;

sensing and producing data signals equivalent to the temperature of the bulk air within said oven means;

utilizing said temperature data signals to compute a curve approximating the temperature variation of the fabric relative to preselected locations within said oven means;

sensing and producing data signals equivalent to the actual frame speed;

preselecting and providing an input signal equivalent to a fabric heat set temperature;

utilizing said computed temperature curve, said actual frame speed signals and said preselected fabric heat set temperature signals to compute a calculated time-at-temperature value;

preselecting and providing input signals equivalent to a desired time-at-temperature target value;

comparing said calculated time-at-temperature value with said preselected time-at-temperature target value and providing a control signal responsive to the difference between the two compared values;

utilizing said control signal to vary the speed of the tenter frame to eliminate the difference between said two compared values.

7. The method as set forth in claim 6 including the step of eliminating a major portion of the moisture in the fabric being treated prior to its entrance into the tenter frame housing.

8. The method as set forth in claim 6 wherein said data signals equivalent to the temperature of the fabric within said oven housing are obtained after all moisture has been removed and its temperature is above 212° F.

* * * * *